United States Patent [19]

McAlister

[11] 4,203,537

[45] May 20, 1980

[54] PAINT CAN ACCESSORY

[75] Inventor: George McAlister, Big Spring, Tex.

[73] Assignee: Plastic-Craft, Inc., Big Spring, Tex.

[21] Appl. No.: 961,410

[22] Filed: Nov. 16, 1978

Related U.S. Application Data

[63] Continuation of Ser. No. 827,577, Aug. 25, 1977, abandoned.

[51] Int. Cl.[2] ..... B65D 25/40

[52] U.S. Cl. ..... 222/570; 220/72; 220/90

[58] Field of Search ..... 220/90, 306, 72; 222/569, 573, 570; 215/305

[56] References Cited

U.S. PATENT DOCUMENTS

| | | | |
|---|---|---|---|
| 2,418,502 | 4/1947 | Ferguson | 220/90 |
| 2,591,482 | 4/1952 | Weltlich | 220/90 |
| 2,715,478 | 8/1955 | Andersen | 220/90 |
| 2,873,881 | 2/1959 | Nichols | 220/90 |
| 2,941,692 | 6/1960 | Kappel | 220/90 |
| 3,128,903 | 4/1964 | Crisci | 220/306 |
| 3,133,668 | 5/1964 | Heise | 220/90 |
| 3,187,919 | 6/1965 | Inglis | 215/305 |
| 3,221,955 | 12/1965 | Banaszak et al. | 220/90 X |
| 3,239,113 | 3/1966 | Knize | 22/569 |
| 3,373,896 | 3/1968 | Davis | 220/306 |
| 3,463,366 | 8/1969 | Spencer | 222/570 |
| 3,688,943 | 9/1972 | Brown | 220/90 |
| 3,899,107 | 8/1975 | Gaal | 220/90 X |
| 4,020,968 | 5/1977 | Chiavola | 222/570 X |

FOREIGN PATENT DOCUMENTS

| | | | |
|---|---|---|---|
| 980907 | 5/1951 | France | 222/570 |
| 1398877 | 4/1965 | France | 215/305 |

*Primary Examiner*—Allan N. Shoap

*Attorney, Agent, or Firm*—Richards, Harris & Medlock

[57] ABSTRACT

The specification discloses a removable paint can accessory for mounting on the rim of a paint can. An annular ring is dimensioned to cover the rim channel of a conventional paint can. A pouring spout integral with the ring extends radially therefrom. The spout includes a substantially planar surface capable of supporting a paintbrush. A leveraging means depending from the pouring spout permits force to be applied along the ring to remove the accessory from the can.

10 Claims, 4 Drawing Figures

PAINT CAN ACCESSORY

This is a continuation of application Ser. No. 827,577 filed Aug. 25, 1977, now abandoned.

BACKGROUND OF THE INVENTION

1. Field of the Invention

The present invention relates to painting accessories and more particularly to accessories for paint cans.

2. Discussion of the Prior Art

The design of conventional paint cans has long been a nuisance to the painter. Paint cans for paint commercially sold are normally filled to the brim; stirring or dipping a brush therein usually causes the overflow of paint into the rim channel and often down the sides of the can, sometimes onto the supporting surface. When paint flows into the rim channel, it may dry and prevent effective resealing of the can by the cover. An inadequate seal allows paint in the can to dry out during storge or may result in spillage if the can is upset. Sometimes wet paint flows into the rim channel and the can is resealed before the paint has an opportunity to dry. The wet paint dries and acts as a cement, making it difficult to remove the lid from the can at a later time. Because the rim channel is so narrow, it is extremely difficult to clean excess paint out of the rim channel.

Furthermore, design of conventional paint cans does not enhance the pouring of paint. The curvilinear boundary of the inside of the can and the rim channel over which paint must flow makes it difficult to control the paintstream and to prevent paint from running down the edges of the can.

Moreover, the curvilinear edge of the inner surface of the paint can does not provide a suitable surface for skimming excess paint from a paintbrush. Scraping the brush against the inside surface of the can does not uniformly remove paint from the brush, which in turn does not enhance uniform application of paint to a surface.

Numerous devices have been designed to solve some of the above-mentioned problems. For example, U.S. Pat. Nos. 2,786,614; 2,945,612; 3,326,409 and 3,423,213 disclose various shields which are inserted into paint cans to prevent the spillage of paint into the rim channel. While these devices shield the rim channel from excess paint, they are not completely effective in preventing the flow of paint into the rim channel because they merely shield, and do not seal, the rim channel from excess paint. While a number of devices have been designed to facilitate pouring of paint from a paint can, none of these devices completely insulate the rim channel from excess paint or possess the advantages of the present invention.

Accordingly, a need arises for a practical paint can accessory which can be rigidly mounted on the rim of a paint can to completely cover and seal the rim channel, which provides for controlled pouring as well as a platform to hold a wet paintbrush and a means for easily removing the attachment from the rim.

SUMMARY OF THE INVENTION

The present invention is directed to a removable paint can attachment which is rigidly mounted on the rim of a paint can to prevent paint from spilling into the rim channel. The present invention also provides a means for controlling the pouring of the paint with minimum dripping and the pouring spout also serves as a brush support platform and a means for scraping a paintbrush after it has been dipped into the paint can. By its construction, the present invention may be easily removed from the paint can when it is no longer needed.

In accordance with the present invention, a removable paint can accessory is dimensioned to be mounted on the annular rim of the paint can. An annular ring is dimensioned to cover the rim channel of the paint can. Depending from the ring around the outer periphery of the can is an outer skirt. An inner flange also depending from the ring is disposed within the rim channel. An inner skirt also depends from the ring and extends around the inner periphery of the can to cooperate with the outer skirt and inner flange to form a paintproof seal between the rim channel and the ring. A pouring spout and brush platform defining a substantially planar surface with an arcuate outer boundary extends radially outwardly from the ring. A surrounding wall circumscribes the ring and the pouring spout. A leveraging means depending from the pouring spout facilitates the removal of the accessory from the paint can.

DESCRIPTION OF THE DRAWINGS

For a more complete understanding of the present invention and for further objects and advantages thereof, reference is now made to the following description taken in conjunction with the accompanying drawings in which.

DESCRIPTION OF THE PREFERRED EMBODIMENT

Figure 1:
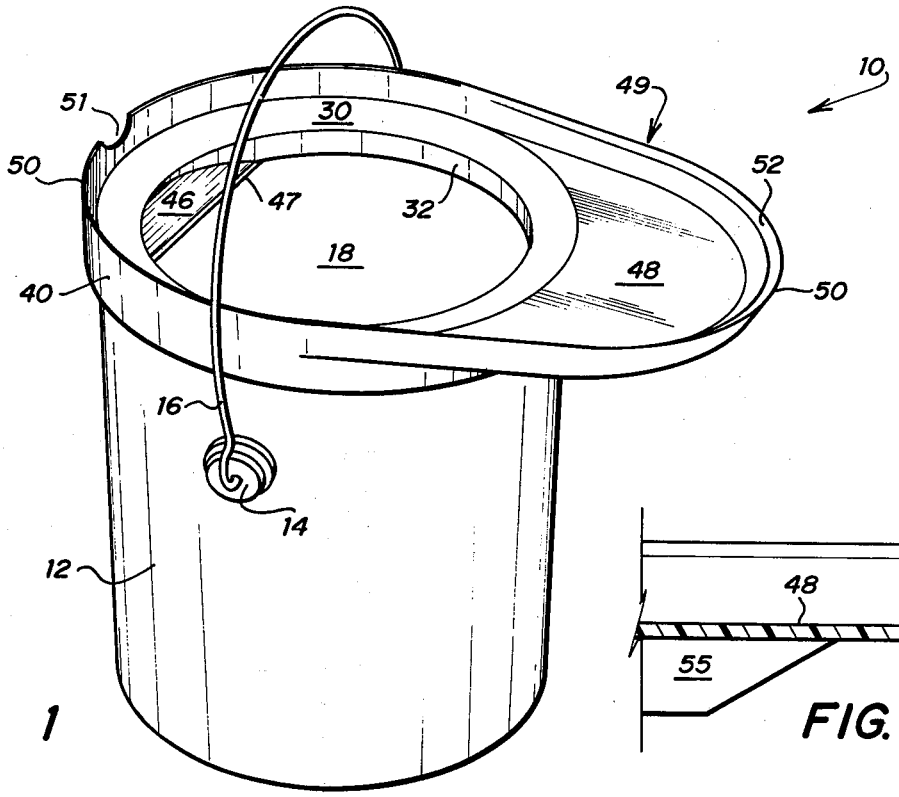
FIG. 1 is a perspective view of the present invention mounted on a conventional paint can showing the bail in upright position.
Figure 4:
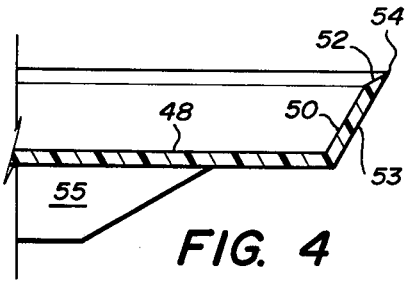
FIG. 4 is a section view taken along the line 4—4 in FIG. 3.
Figure 2:
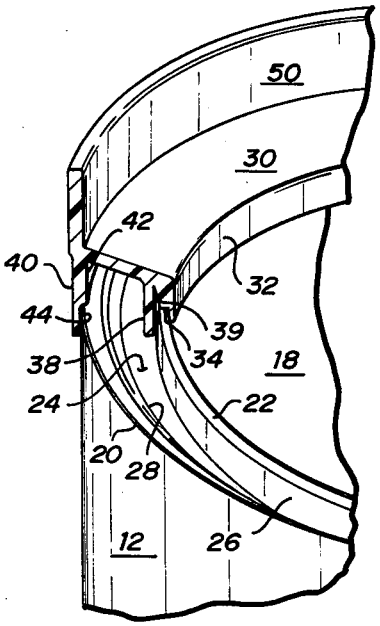
FIG. 2 is a section view of the preferred embodiment of the invention.

FIG. 1 illustrates the preferred embodiment of a paint can accessory 10 mounted on a conventional paint can 12 which is a cylindrically shaped metal container having two studs 14 oppositely disposed on each side thereof to which is pivotally attached a bail 16 for transporting the container. The topmost portion of paint can 12 defines a circular opening 18 into which a brush or stirring stick may be introduced. As best shown in FIG. 2, the topmost portion of paint can 12 is circumscribed by an outer rim 20 which serves to partially enclose and support the lid of the can.

The circular opening 18 of paint can 12 is defined by an inner bed 22 which is concentric with outer rim 20 and disposed inwardly therefrom. An outwardly opening rim channel 24 is disposed concentrically between inner bead 22 and outer rim 20. Rim channel 24 is defined by inner channel wall 26, adjacent to inner bead 22, and an outer channel wall 28, adjacent to outer rim 20. Rim channel 24 is dimensioned to receive a corresponding circular mating element defined on the paint can lid, which forms no part of the present invention and, accordingly, is not shown.

With reference to FIG. 1, the preferred embodiment of the present invention contemplates an annular ring 30, designed to cover the rim channel 24. Ring 30 is an annular surface beveled inwardly toward opening 18 so that excess paint deposited thereon tends to flow back into the opening. The width of ring 30 spans the entire diameter of the paint can rim so that the ring engages the inner bead and outer rim of the can to form a paintproof seal.

Depending from ring 30 is an inner skirt 32, designed to abut with and partially encompass inner bead 22 to prevent paint from penetrating under ring 30. As best illustrated in FIG. 2, the interior wall of inner skirt 32 is both outwardly and inwardly contoured to define an annular groove 34 dimensioned to receive inner bead 22. An outwardly contoured jog rests snugly under the inner bead 22 to form a paintproof seal around the inner bead. Inner skirt 32 extends into the opening 18 only sufficiently far for the jog to fit snugly under inner bead 22 so that mounting the accessory on the rim of a full paint can will not cause overflow or force paint up under the ring.

Figure 3:
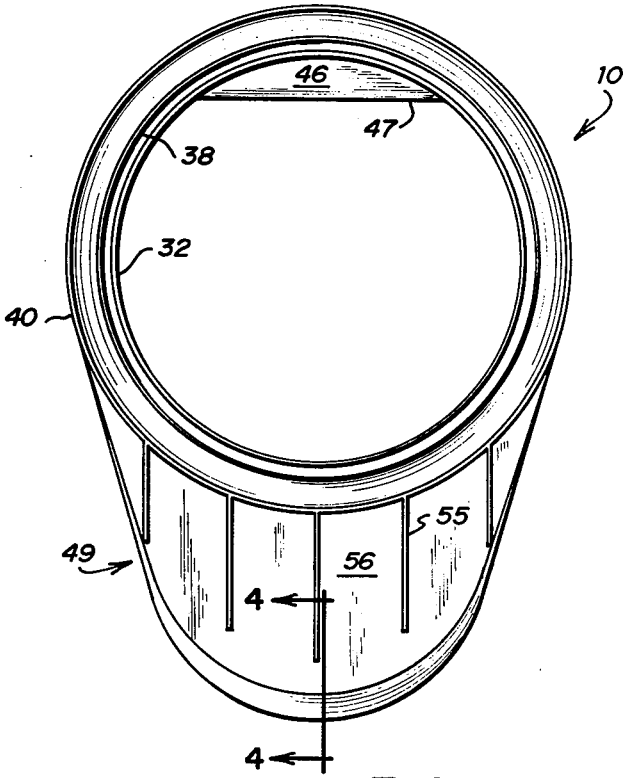
FIG. 3 is a bottom plan view of the preferred embodiment of the invention.

As shown in FIGS. 2 and 3, an inner flange 38, also extending from ring 30, is disposed in rim channel 24 when the accessory is mounted on the rim of a paint can. Inner flange 38 is concentric to inner skirt 32 and disposed in relation thereto so that inner bead 22 must be forced into the space between inner flange 38 and inner skirt 32 as the ring is snapped over the rim.

The relative position of inner skirt 32 and inner flange 38 results in a compression of inner skirt 32 against inner bead 22 to form a paintproof seal. Since the accessory is manufactured of a slightly resilient material, such as low density polyethylene, the inner skirt 32 and inner flange 38 are capable of sufficient flexion to receive the inner bead of the can therebetween. The resiliency of the inner flange 38 is further enhanced by an annular slice 39 in the underside of ring 30 between inner flange 38 and inner skirt 32, which weakens the resistance of the inner flange 38 to bending. The flexibility of inner flange 38 and inner skirt 32 permits the accessory to be used on paint cans having slightly different rim configurations and on paint cans of slightly different size than the standard paint can for which the preferred embodiment is designed.

As best seen in FIGS. 1–3, an outer skirt 40 extends from annular ring 30 around the outer rim 20 of the paint can so that ring 30 completely covers the rim of the can. In the preferred embodiment, outer skirt 40 has substantially the same axial length as inner flange 38, which is somewhat greater than the axial length of inner skirt 32. As with inner flange 38, the relative position of outer skirt 40 with respect to inner skirt 32 and inner flange 38 and the flexibility of skirts 32 and 40 and flange 38, provides the necessary compressive force to create a paintproof seal around the inner and outer peripheries of the can. Along the circle where outer skirt 40 passes over outer rim 20, the interior wall 42 of outer skirt 40 is contoured inwardly to define an annular notch 44 which receives outer rim 20 when the paint can accessory is mounted on the can to support ring 30 above the rim channel 24.

Extending from inner skirt 32 across opening 18 is a scraper 46, a planar surface inclined inwardly toward opening 18 defining a straight, sharp edge 47. Scraper 46 is sufficiently wide to provide uniform scraping of wet paint from a paintbrush, which is not possible when using the circular edges of a conventional paint can. The inclination of the surface of scraper 46 causes excess paint to flow or drip into opening 18.

The pouring spout 49 comprises a spout surface 48 and a portion of the surrounding wall 50 which encircles ring 30 and spout surface 48. A spout surface 48 integral with ring 30 extends radially outwardly from the ring 30. Spout surface 48 is substantially planar with continually changing radius, the outwardly sides thereof are defined partially by inwardly sloping tangents to the exterior of ring 30 which terminate in the outermost edge having arcuate boundary. The planar surface spout surface 48 has a geometry which facilitates the pouring of paint when the paint can is tilted as well as providing a resting area for the bristles of the paintbrush whose handle portion may be disposed across the opening 18 of ring 30. To facilitate the use of spout surface 48 as a support for a paintbrush, a notch 51 may be formed in surrounding wall 50 near scraper 46 in which the tail of the paintbrush handle may rest.

A surrounding wall 50 surrounds ring 30 and spout surface 48 which extends radially therefrom. As best shown in FIG. 1, surrounding wall 50 is substantially perpendicular to the plane of spout surface 48 except along the outermost arcuate boundary. Around the ring of the accessory, surrounding wall 50 serves as a shield to retain paint inside the can. Along the arcuate boundary of the spout surface 48, the surrounding wall 50 starts to angle outwardly away from the spout surface 48 in a continuously increasing oblique angle to the spout surface, as the outermost edge of the spout surface is approached, to define pouring spout 49. It has been found in practice that the continuously changing angle of the pouring spout and the choice of a 120 degree angle at the point of maximum radius permits pouring and cutting off of the paintstream with minimum drip. The upper edge 52 of wall 50 along pouring spout 49 angles outwardly from wall 50, which is already disposed at an angle to the spout surface 48. As with that portion of wall 50 which defines a pouring spout, upper edge 52 likewise angles outwardly from wall 50 in a continuously changing angle which increases and decreases with the increasing and decreasing radius of pouring spout 49. The exterior 53 of wall 50 is parallel with wall 50 so that it forms a sharp cutting edge 54 around the spout where exterior 53 intersects with upper edge 52. It has been found in practice that the continuously changing angle of the pouring spout and the choice of a 120 degree angle at the point of maximum radius permits pouring and cutting off of the paintstream with minimum drip. The changing angle of the upper edge 52 and the sharp cutting edge 54 around the spout allow the painter to terminate paintstream instantly without causing excessive dripping or spillage of paint.

It will be appreciated that the manufacture of the paint can accessory from a material having slight resilience, such as low density polyethylene, permits the surrounding wall to sustain slight inward pressure to permit the bail to be used in vertical position for transporting the can when the accessory has been mounted thereon.

From the above discussion, it will be apparent that the paint can accessory can be rigidly mounted on a conventional paint can to form a paintproof seal about the rim. While the present invention can be attached to the paint can with stability which cannot be approached by many prior art devices, this makes it desirable to provide a feature which permits the easy removal of the accessory from the paint can. In the present invention, this is accomplished by means of a plurality of ribs 55 extending from the outer skirt 40 along the underside 56 of the spout surface 48. The ribs are parallel to one another and equally spaced about the outer skirt so as to provide space for the fingers of the painter's hand to fit therein. To remove the accessory from the can, the painter places his fingers between the ribs and pushes up to leverage the ring along a portion of the rim, rather than just at a single point. As shown in FIG. 3, ribs 55 do not extend completely to the arcuate boundary of the spout surface but are spaced some little distance therefrom. This is to prevent the flow of paint into the spaces defined between the ribs 55 which might be occasioned by dripping of paint onto the underside 56; it also makes it easy to remove excess paint from the underside 56 by wiping with a rag before removing the accessory from the can.

The entire accessory is manufactured as a single unit by injection molding a suitable plastic such as polyethylene. Low density polyethylene is an exemplary material because it provides the slight resiliency necessary to form a paintproof seal around the rim, making the accessory adaptable to different sized containers as well as providing flexibility in the surrounding wall to permit the bail to be used in vertical position. Low density polyethylene also has the useful property that latex paints will not adhere to the surface thereof and paint deposited thereon and dried may be easily peeled from the surface of the accessory in strips or sheets.

Although particular embodiments of the invention have been described herein, it will be understood that the invention is not limited to the embodiments disclosed, but is capable of rearrangement, modification and substitution of parts and elements without departing from the spirit and scope of the invention.

What is claimed is:

1. A paint can accessory adapted to be removably mounted on the annular rim of a paint can to prevent paint from flowing into the rim channel thereof, comprising:

an annular ring disposed over the rim channel of the paint can, said ring having an outer skirt depending therefrom extending around the outer periphery of the can and an inner skirt depending therefrom extending around the inner periphery of the can;

a pouring spout for pouring paint from the can extending substantially horizontally and in substantially the radial plane of said ring, said spout being substantially planar and having an edge of constantly changing radius, and said spout also being circumscribed by a wall extending substantially around said ring; and a plurality of leveraging ribs depending axially from the underside of said spout and extending laterally from said outer skirt in substantially parallel spaced apart relation for transmitting leveraging force to a sector of said ring, said ribs being spaced sufficiently far apart and having sufficient axial depth so that the fingers of the hand contact the underside of said spout in the channels formed between said ribs when leveraging force is applied to remove the accessory from the can, the ribs varying in length relative to their lateral dimension to correspond with the changing radius of the spout with the ribs being shorter adjacent the lateral edges of the spout.

2. The removable paint can accessory as defined in claim 1, further comprising:

scraping means disposed across said annular ring for scraping excess paint from a paintbrush, said scraping means defining a substantially planar surface having a sharp linear edge, the surface of said scraping means inclined toward the inside of said ring to facilitate the dripping of paint into the can.

3. The removable paint can accessory as defined in claim 1 wherein the inside surface of said annular ring is beveled to facilitate drainage of excess paint into the can.

4. The removable paint can accessory as defined in claim 1 wherein said inner skirt defines an annular groove on the interior thereof for receiving the inner periphery of said can, said inner skirt cooperating with said outer skirt to form a paint proof seal between said ring and the rim of the can.

5. The removable paint can accessory as defined in claim 1 wherein said leveraging ribs extend partially to the edge of said spout to provide clearance for removing excess paint from around the edge of said spout.

6. The removable paint can accessory as defined in claim 1 wherein said wall of said pouring spout is angled obliquely outwardly from said spout along the arcuate edge thereof.

7. The paint can accessory as defined in claim 1 wherein said wall has sufficient flexibility such that when mounted on a paint can having a bail, said bail can be used in upright position.

8. The paint can accessory as defined in claim 1 wherein said accessory is made of low density polyethylene to prevent latex paints from adhering to the surface thereof.

9. The removable paint can accessory as defined in claim 1 wherein said wall of said spout is angled outwardly from the surface thereof at an increasing angle as the radius of said spout increases and at a decreasing angle as the radius of said spout decreases.

10. The removable paint can accessory as defined in claim 9 wherein said wall is angled at a maximum angle of about 120 degrees from the surface of said spout at the maximum radius of said spout.

* * * * *